US005514511A

United States Patent [19]

Iwamoto et al.

[11] Patent Number: 5,514,511

[45] Date of Patent: May 7, 1996

[54] TONER FOR DEVELOPING LATENT ELECTROSTATIC IMAGES

[75] Inventors: Yasuaki Iwamoto, Numazu; Toshiki Nanya, Mishima, both of Japan

[73] Assignee: Ricoh Company, Ltd., Tokyo, Japan

[21] Appl. No.: 274,019

[22] Filed: Jul. 12, 1994

[30] Foreign Application Priority Data

Jul. 13, 1993 [JP] Japan ..... 5-172999
Jul. 5, 1994 [JP] Japan ..... 6-153593

[51] Int. Cl.[6] ..... G03G 9/087
[52] U.S. Cl. ..... 430/110
[58] Field of Search ..... 430/106, 109, 430/110, 111, 45

[56] References Cited

U.S. PATENT DOCUMENTS 5,362,593 11/1994 Inoue et al. ..... 430/111

FOREIGN PATENT DOCUMENTS 0103967 3/1984 European Pat. Off. .
0207628 1/1987 European Pat. Off. .
0509464 10/1992 European Pat. Off. .
2016725 9/1979 United Kingdom .

*Primary Examiner*—John Goodrow
*Attorney, Agent, or Firm*—Cooper & Dunham

[57] ABSTRACT

A toner for developing latent electrostatic images including a coloring agent, and a binder resin composition having resin particles, each resin particle having a matrix and domain particles with an average particle diameter of 0.5 to 2.0 μm dispersed in the matrix; with the toner having such rheological characteristics that the storage elastic modulus (G') thereof at 80° to 100° C. under a frequency of 100 Hz is in the range of $5\times10^6$ to $5\times10^7$ dyne/cm$^2$, and the loss elastic modulus (G") thereof at 200° to 220° C. under a frequency of 100 Hz is in the range of $1\times10^3$ to $1\times10^5$ dyne/cm$^2$.

4 Claims, No Drawings

TONER FOR DEVELOPING LATENT ELECTROSTATIC IMAGES

BACKGROUND OF THE INVENTION

1. Field of the Invention

The present invention relates to a toner for developing latent electrostatic images, which is utilized in the fields of electrophotography, electrostatic recording and electrostatic printing.

2. Discussion of the Background

Various kinds of electrophotographic methods are conventionally known as disclosed in U.S. Pat. No. 2,297,691 and Japanese Patent Publications 42-23910 and 43-24748. According to these methods, latent electrostatic images are formed on a photoconductor by utilizing a photoconductive material contained in the photoconductor, and the latent electrostatic images are developed into visible images with a toner. The visible toner images thus obtained are transferred to an image-receiving medium such as a sheet of paper when necessary. The transferred toner images are then fixed on the image-receiving medium, for instance, with the application of heat and/or pressure thereto, or by the application of a solvent vapor thereto. Toner-image-bearing copies are thus obtained.

Many systems for fixing the toner image on the image-receiving medium have been developed. Among them, the pressure and heat application system, that is, the heat roller fixing is generally employed at the present stage. A heat roller for use with the heat roller fixing method is fabricated in such a manner that the surface of the heat roller is coated with a material having releasability with respect to the toner to be employed. The image-receiving medium which bears the toner image thereon is caused to pass through the heat roller in such a condition that the toner-image-bearing surface of the image-receiving medium is brought into contact with the surface of the heat roller with the image-receiving medium being urged to the heat roller by the application of pressure, thereby achieving the fixing of toner image on the image-receiving medium.

The image-fixing at a low temperature, which has become an important research topic, can be attained by decreasing the melt viscosity of a binder resin for use in the toner. More specifically, there is proposed a method of decreasing the molecular weight and the glass transition temperature of the binder resin. However, the decrease of the molecular weight and the glass transition temperature of the binder resin means the deterioration of the preservability of the toner. Toner particles tend to cause the blocking phenomenon, and the toner particles are fused and attached to the surface of a development drum.

In Japanese Patent Publication 63-32182 it is proposed to attain the image-fixing at a low temperature and improve the fluidity of toner particles and prevent the stain of a toner-bearing member such as a photoconductor with the toner particles. In the above-mentioned proposal, the binder resin for use in the toner comprises a mixture of a low-molecular weight vinyl polymer which shows at least one maximum peak in the specified low molecular weight region and a high-molecular weight vinyl polymer which shows at least one maximum peak in the specified high molecular weight region. The amount of the low-molecular weight vinyl polymer is relatively large in the toner to improve the image-fixing properties. As a result of the study by the inventors of the present invention, however, it is confirmed that there are too many vinyl polymer components which cannot effectively contribute to the improvement of the image-fixing properties between the maximum peak of the low-molecular weight vinyl polymer component and that of the high-molecular weight vinyl polymer component. Therefore, not only the image-fixing properties, but also the off-set resistance is still insufficient for practical use.

Understandably, therefore, it is extremely difficult to attain the fixing of toner images at a low temperature, expand the temperature region in which the toner images can be fixed on the image-receiving medium, and satisfy the general requirements for the toner, such as the preservability, fluidity and durability, at the same time.

To solve the above-mentioned problems, a resin composition for use in the toner is proposed in Japanese Laid-Open Patent Application 5-331374. The resin composition comprises resin particles, each resin particle comprising a matrix and domain particles with an average particle diameter of 5 μm or less, which are dispersed in the matrix. The glass transition temperature $Tg_1$ of a resin $P_1$ for use in the domain particles is in the range from 0° to 60° C., and the glass transition temperature $Tg_2$ of a resin $P_2$ for use in the matrix is in the range from 40° to 90° C., and the relationship of $Tg_2 \geqq Tg_1+10°$ C. is satisfied. The resin $P_2$ comprises a carboxyl group, while the resin $P_1$ comprises no carboxyl group. In addition, according to the measurement by gel permeation chromatography (GPC) the molecular weight of the resin $P_2$ is in the range from 5,000 to 20,000, and that of the resin $P_1$ is in the range from 500,000 to 1,000,000, with at least one maximum peak in the respective molecular weight regions. The maximum peak in the low molecular weight region has a height $H_1$, the maximum peak in the high molecular weight region has a height $H_3$, and the minimum peak between the both maximum peaks has a height $H_2$, with the ratio of $H_1:H_2:H_3$ being (3–25):1:(1.5–12). Furthermore, the aforementioned resin composition for use in the toner is characterized in that the ration of the weight-average molecular weight (Mw) to the number-average molecular weight (Mn) of the resin composition is 15 to 80.

The image-fixing at a low temperature can be achieved and the blocking resistance of the toner is improved by using the above-mentioned toner composition. However, there is the problem that a so-called spent toner is deposited on the carrier. The reason for this problem is that the domain particles for use in the resin composition cannot be uniformly dispersed in the matrix and the domain particles with a desired particle diameter cannot be obtained. When the domain particles are not uniformly dispersed in the matrix, many domain particles whose melting point is lower than that of the matrix locally stud the surface of the matrix. Consequently, the spent-toner preventing effect inherent in the matrix is disturbed by the domain particles which are present on the surface of the matrix, and the domain particles are easily attached to the carrier.

As previously explained, when each resin particle of a binder resin for use in the toner comprises a matrix and domain particles dispersed in the matrix, it is essential that the domain particles with a predetermined particle diameter be uniformly dispersed in the matrix in order to achieve the fixing of a toner image at a low temperature.

The resin composition as disclosed in Japanese Laid-Open Patent Application 5-331374 is prepared in such a manner that two kinds of resins which are separately obtained by polymerization are dissolved and stirred in a polar or non-polar solvent with the application of heat thereto. Therefore, it is difficult to obtain the domain particles with a desired particle diameter, and uniformly disperse the domain particles in the matrix. In particular, when a vinyl resin is used for the domain particles, the above-mentioned problems are conspicuous, and the amount of the spent toner deposited on the carrier is increasing as the image-fixing temperature is decreasing.

Furthermore, there is also the problem that the charge quantity of the toner changes depending upon the ambient conditions. When image formation is carried out under the circumstances of high temperature and high humidity, the image density of the obtained toner image is lowered because of the decrease of the charge quantity of the toner.

There is no toner that can satisfy all the above-mentioned mentioned requirements at the present stage.

SUMMARY OF THE INVENTION

Accordingly, a first object of the present invention is to provide a toner for developing latent electrostatic images, which is capable of achieving image-fixing at a low temperature without the hot off-set phenomenon and the blocking phenomenon.

A second object of the present invention is to provide a toner with good durability, which does not cause the spent-toner problem during a long period of repeated image forming operation.

A third object of the present invention is to provide a toner capable of acquiring a constant charge quantity regardless of the environmental conditions.

The above-mentioned objects of the present invention can be achieved by a toner for developing latent electrostatic images comprising a coloring agent, and a binder resin composition comprising resin particles, each resin particle comprising a matrix and domain particles with a particle diameter of 0.5 to 2.0 μm dispersed in the matrix, with the toner having such rheological characteristics that the storage elastic modulus (G') thereof at 80° to 100° C. under a frequency of 100 Hz is in the range of $5\times10^6$ to $5\times10^7$ dyne/cm$^2$, and the loss elastic modulus (G") thereof at 200° to 220° C. under a frequency of 100 Hz is in the range of $1\times10^3$ to $1\times10^5$ dyne/cm$^2$.

In the above first mentioned toner the domain particles for use in the binder resin composition may comprise a vinyl resin and the matrix may comprise at least one resin selected from the group consisting of polyester, polyester amide, and polyamide.

In the above first mentioned toner the binder resin composition may have an acid value of 15 KOH mg/g or less, and comprise components which are insoluble in chloroform in an amount of 30 wt. % or less.

Furthermore, the above first mentioned toner may further comprise a fluorine-containing quaternary ammonium salt compound of formula (I):

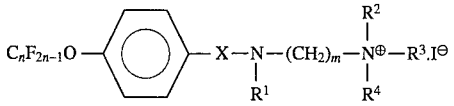

(I)

wherein X is —$SO_2$— or —CO—; $R^1$, $R^2$, $R^3$ and $R^4$ each is hydrogen, an alkyl group having 1 to 10 carbon atoms or an aryl group; and m and n are integers of 1 or more.

DESCRIPTION OF THE PREFERRED EMBODIMENTS

A toner of the present invention comprises a coloring agent, and a binder resin composition comprising resin particles, each resin particle comprising a matrix and domain particles with a particle diameter of 0.5 to 2.0 μm dispersed in the matrix. To uniformly disperse the domain particles in the matrix, and to obtain the domain particles with a desired particle diameter, monomers for preparing the matrix and those for the domain particles are placed in the same container, and two polymerization reactions are carried out independently.

The domain particles are prepared by addition polymerization, that is, radical polymerization; while the matrix is prepared by condensation polymerization. In the present invention, the domain particles may comprise a vinyl resin, and the matrix may comprise at least one resin selected from the group consisting of polyester, polyester amide and polyamide.

When the polyester is synthesized for the matrix by condensation polymerization, the monomers of an alcohol, and a carboxylic acid, a carboxylic acid ester or a carboxylic anhydride are subjected to polymerization.

Examples of the dihydric alcohol used for the preparation of the polyester resin include alkylene oxide adducts of bisphenol A such as polyoxypropylene(2,2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane and polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A and hydrogenated bisphenol A.

Examples of the alcohol monomer with three or more hydroxyl groups include sorbitol, 1,2,3,6-hexanetetrol, 1,4-sorbitan, pentaerythritol, dipentaerythritol, tripentaerythritol, 1,2,4-butanetriol 1,2,5-pentanetriol, glycerol, 2-methylpropanetriol, 2-methyl-1,2,4-butanetriol, trimethylolethane, trimethylolpropane and 1,3,5-trihydroxymethylbenzene.

Examples of the carboxylic acid used for the preparation of the polyester resin include dicarboxylic acids such as maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic n-octylsuccinic acid, isooctenylsuccinic acid, isooctylsuccinic acid; and anhydrides and lower alkyl esters of the above dicarboxylic acids.

Examples of the carboxylic acids with three or more carboxyl groups include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and anhydrides and lower alkyl esters of the above carboxylic acids with three or more carboxyl group.

For the domain particles for use in the resin composition, a vinyl resin may be synthesized by the radical polymerization using a polymerization initiator, such as a peroxide or an azo compound.

As the monomers for preparation of the vinyl resin, styrene and styrene derivatives, unsaturated monoolefins, vinyl esters, monocarboxylic acids and esters thereof, substituted materials of monocarboxylic acids, dicarboxylic acids and substituted materials thereof, vinyl ketones, vinyl ethers, halogenated vinylidene compounds, and N-vinyl compounds can be employed in the present invention.

Specific examples of the vinyl monomer subjected to polymerization are styrene, O-methylstyrene, m-methylstyrene, p-methylstyrene, α-methylstyrene, p-ethylstyrene, 2,4-dimethylstyrene, p-chlorostyrene, vinylnaphthalene, ethylene, propylene, butylene, isobutylene, vinyl chloride, vinyl bromide, vinyl fluoride, vinyl acetate, vinyl propionate, vinyl formate, vinyl caproate, acrylic acid, methyl acrylate, ethyl acrylate, n-propyl acrylate, isopropyl acrylate, n-butyl acrylate, isobutyl acrylate, tert-butyl acrylate, amyl acrylate, cyclohexyl acrylate, n-octyl acrylate, isooctyl acrylate, decyl acrylate, lauryl acrylate, 2-ethylhexyl acrylate, stearyl acrylate, methoxyethyl acrylate, 2-hydroxyethyl acrylate, glycidyl acrylate, 2-chloroethyl acrylate, phenyl acrylate, methyl α-chloroacrylate, methacrylic acid, methyl methacrylate, ethyl methacrylate, n-propyl methacrylate, isopropyl methacrylate, n-butyl methacrylate, isobutyl methacrylate, tert-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate, phenyl methacrylate, dimethylaminoethyl methacrylate, diethylaminoethyl methacrylate, acrylo-nitrile, methacrylonitrile, acrylamide, dimethyl maleate, vinyl methyl ketone, vinyl methyl ether, vinylidene chloride, N-vinyl pyrrole, and N-vinyl pyrrolidone.

When the crosslinking agent is employed in the polymerization of the vinyl monomers, the following crosslinking agents can be appropriately employed: divinylbenzene, divinylnaphthalene, polyethylene glycol dimethacrylate, diethylene glycol diacrylate, triethylene glycol diacrylate, 1,3-butylene glycol dimethacrylate, 1,6-hexylene glycol dimethacrylate, neopentyl glycol dimethacrylate, dipropylene glycol dimethacrylate, polypropylene glycol dimethacrylate, 2,2'-bis(4-methacryloxdiethoxyphenyl)propane, 2,2'-bis(4-acryloxydiethoxyphenyl)propane, trimethylolpropane trimethacrylate, trimethylolpropane triacrylate, tetramethylolmethane tetraacrylate, dibromoneopentyl glycol dimethacrylate, and diallyl phthalate. These crosslinking agents may be used alone or in combination.

It is preferable that the amount of the crosslinking agent be in the range of 0.001 to 15 parts by weight, more preferably in the range of 0.1 to 10 parts by weight, to 100 parts by weight of the polymerizable monomers. When the amount of the crosslinking agent is within the above range, the toner can readily be melted by the application of heat thereto, thereby preventing the decrease of the image-fixing properties of the toner by the application of heat and/or pressure. At the same time, the proper amount of the crosslinking agent in the polymerization can effectively prevent the off-set phenomenon that a part of the toner images formed on the image-receiving medium is not fixed thereon and attaches to the surface of the heated roller.

Examples of the polymerization initiator used for the preparation of the vinyl resin include azo or diazo polymerization initiators, such as 2,2'-azobis(2,4-dimethylvaleronitrile), 2,2'-azobisisobutyronitrile, 1,1'-azobis(cyclohexane-1-carbonitrile), and 2,2'-azobis-4-methoxy-2,4-dimethylvaleronitrile; and peroxide polymerization initiators such as benzoyl peroxide, methyl ethyl ketone peroxide, isopropyl peroxycarbonate, cumene hydroperoxide, 2,4-dichlorobenzoyl peroxide, lauroyl peroxide and dicumyl peroxide.

A plurality of the above-mentioned polymerization initiators may be used in combination in order to adjust the molecular weight and the molecular weight distribution of the obtained vinyl resin, and control the reaction time. It is preferable that the amount of the polymerization initiator be in the range of 0.1 to 20 parts by weight, more preferably in the range of 1 to 10 parts by weight, to 100 parts by weight of the polymerizable monomers.

It is desirable that the vinyl resin thus obtained for the domain particles have a weight-average molecular weight of 9,000 to 11,000.

The method of manufacturing the binder resin composition for use in the present invention will now be explained more specifically.

For instance, monomers for preparing the polyester, polyester amide or polyamide for the matrix (hereinafter referred to as monomers A) are placed in a reaction vessel previously. Thereafter, a mixture of monomers for preparing the vinyl resin for the domain particles (hereinafter referred to as monomers B) and a polymerization initiator is added dropwise to the monomers A to mix together, and then, the radical polymerization reaction for obtaining the vinyl resin is first carried out. After the completion of the radical polymerization, the reaction temperature is increased and the reaction vessel is highly evacuated to carry out the condensation polymerization, so that the polyester, polyester amide or polyamide resin for use in the matrix of the resin composition is obtained. According to the above-mentioned method, two kinds of resins can efficiently be synthesized independently in the same reaction vessel by the radical polymerization reaction and the condensation polymerization. Consequently, the thus obtained vinyl resin is evenly mixed with the polyester, polyester amide or polyamide resin serving as the matrix, and the vinyl resin is uniformly dispersed in the matrix resin.

In the above-mentioned manufacturing method it is not necessary to carry out and complete the two polymerization reactions simultaneously. The radical polymerization and the condensation polymerization may proceed sequentially by appropriately adjusting the reaction temperature and the reaction time depending on each reaction mechanism.

When the condensation polymer resin thus obtained, such as polyester, polyester amide or polyamide, is mixed with the vinyl resin such as styrene-acrylic resin to prepare the resin composition for use in the present invention, it is preferable that the amount ratio by weight of the condensation polymer resin for the matrix to the vinyl resin for the domain particles be in the range from 10:90 to 90:10.

In this case, the particle diameters of the domain particles are determined by controlling the amount of the vinyl resin. The more the amount ratio of the vinyl resin to the condensation polymer resin, the larger the particle diameters of the obtained domain particles. In the present invention the particle diameters of the domain particles are controlled within the range of 0.5 to 2 μm. When the average particle diameter of the domain particles exceeds 2 μm, the blocking resistance of the obtained toner particles is decreased although the spent toner attached to the carrier is not particularly increased. On the other hand, when the average particle diameter of the domain particles is less than 0.5 μm, the effect for attaining the image-fixing at a low temperature is drastically reduced.

In recent years, the thermal energy of a heated roller for image-fixing is decreased to cope with the high-speed copying operation. Therefore, it is difficult to successfully achieve the image-fixing at a low temperature only by decreasing the glass transition temperature of the toner. It is desired that the image-fixing at a low temperature be successfully achieved, with such characteristics of the toner as readily melted by the application of heat being satisfied. In the present invention the rheological characteristics of the toner is controlled in such a fashion that the storage elastic modulus (G') thereof at 80° to 100° C. under a frequency of 100 Hz is in the range of $5\times10^6$ to $5\times10^7$ dyne/cm$^2$, and the loss elastic modulus (G") thereof at 200° to 220° C. under a frequency of 100 Hz is in the range of $1\times10^3$ to $1\times10^5$ dyne/cm$^2$. The image-fixing at a desired low temperature can be achieved by imparting such rheological characteristics to the toner in the present invention.

The storage elastic modulus (G') of the toner stands for the cohesive force of the toner, while the loss elastic modulus (G"), for the viscosity of the toner. When the storage elastic modulus (G') of the toner exceeds the above-mentioned range, the fixing characteristics of the toner at a low temperature are decreased although the off-set phenomenon can effectively be prevented because of the increased cohesive force of the toner. When the loss elastic modulus (G") of the toner exceeds the above-mentioned range, satisfactory fixing characteristics of the toner at a low temperature can be obtained, but the off-set phenomenon easily tends to occur. In addition, when the storage elastic modulus (G') and the loss elastic modulus (G") of the toner are less than the above mentioned range, the toner cannot be manufactured in a stable condition.

The storage elastic modulus (G') and the loss elastic modulus (G") of the toner are measured by the following method:

A sample of toner is formed into a 20 mm×20 mm sheet with a thickness of 2 mm by heating under pressure. Using a commercially available measuring instrument "Dynamic Spectrometer DVE model" (Trademark), made by Rheometrics Far East Ltd., a sine wave with a frequency of 10 to 100 Hz is applied to the toner sample in a shearing direction while the toner sample is maintained at a predetermined temperature. The stress generated in response to the imposed motion is measured, and the storage elastic modulus (G') and the loss elastic modulus (G") of the toner sample are calculated from the imposed motion and the strain in accordance with the conventional formulas.

Furthermore, it is preferable that the acid value of the binder resin composition for use in the toner of the present invention be 15 KOH mg/g or less, more preferably 10 KOH mg/g or less. When the acid value of the binder resin composition is 15 KOH mg/g or less, the change in the charge quantity of the toner depending on the change of the environmental conditions can be minimized. In addition, it is preferable that the binder resin composition comprise the components which are insoluble in chloroform in an amount of 30 wt. % or less, more preferably, 20 wt. % or less. When the amount of the components insoluble in chloroform is 30 wt. % or less, the image-fixing at a low temperature can be achieved easily.

The acid value of the binder resin composition is measured by the following method as defined in JIS K0070:

A sample of the binder resin composition is finely pulverized and passed through a 40-mesh sieve. About 0.6 g of the resin sample are put into a 100-ml conical flask, and 30 to 50 ml of a mixed solvent of acetone and toluene with a mixing ratio of 1:1 and phenolphtalein serving as an indicator are added to the sample of the resin composition. The thus prepared mixture is stirred with a magnetic stirrer to dissolve the resin sample in the solvent at a room temperature. The acid value of the resin sample is determined by titration with one-tenth normal (0.1N) potassium hydroxide alcohol solution. Under these conditions the end-point of titration can be found when the solution of the resin composition assumes a pale red color for 30 seconds.

The amount of the components in the binder resin composition which are insoluble in chloroform is measured in accordance with the following method:

Approximately 50 g of chloroform are added to 1.0 g of a sample of the binder resin composition, and this mixture is allowed to stand at 20° C. for 24 hours. The mixture is subjected to centrifugation and then filtration at room temperature, using a quantitative filter paper No. 5C defined in JIS P-3801.

The residue thus obtained on the filter paper after the completion of filtration is regarded as a component insoluble in chloroform, and the amount of the component insoluble in chloroform is expressed by the weight percentage (wt. %) of the above obtained residue to the resin sample.

The present invention will now be explained in detail by referring to the synthesis examples of the binder resin compositions.

SYNTHESIS EXAMPLE 1

A mixture of 400 g of polyoxypropylene(3.3)-2,2-bis(4-hydroxyphenyl)propane, 130 g of terephthalic acid, 40 g of 1,2,4-naphthalenetricarboxylic acid, and 1.1 g of tin oxide (hereinafter referred to as a mixture A-1) was placed in a four-necked 5-l glass flask equipped with a thermometer, a stainless steel stirrer, a condenser and a nitrogen-introducing inlet. The mixture (A-1) was heated to 125° C. in a mantle heater and stirred in a stream of nitrogen.

A mixture of 650 g of styrene, 350 g of butyl methacrylate and 55 g of methyl ethyl ketone peroxide (hereinafter referred to as a mixture B-1) was added dropwise to the above-mentioned reaction mixture (A-1) through a dropping funnel over a period of 6 hours. The temperature of the reaction system was maintained at 125° C. for 7 hours. Thus, the radical polymerization of the mixture (B-1) was completed.

After that, the reaction system was heated to 230° C. and the flask was evacuated to less than 1.5 Torr to induce the condensation polymerization of the mixture (A-1). The conversion of polymerization was followed by the measurement of the softening point of the mixture (A-1) in accordance with the method described in ASTM E-28-67. The polymerization reaction was terminated when the softening point of the mixture (A-1) reached 115° C.

Thus, a resin composition No. 1 was obtained.

When the resin composition No. 1, which was a pale white solid, was subjected to differential thermal analysis, there was observed one peak of the glass transition temperature (Tg) at 61° C.

The acid value of the resin composition No. 1 was 7.1 KOH mg/g, and the insoluble content in chloroform was 18.2 wt. %.

The condition of the resin composition No. 1 was observed by using the scanning electron microscope (SEM). The domain particles with an average particle diameter of 1 μm were uniformly dispersed in the matrix. For the observation, the resin composition No. 1 was cut to obtain a thin film with a proper thickness. Pictures of the cross sections of the resin composition No. 1 were taken at random at six positions, and the particle diameters of the recognizable domain particles were measured. The average of the particle diameters thus measured was regarded as the average particle diameter of the domain particles. When necessary, to easily recognize the domain particles, it was possible to add an appropriate amount of a rhodamine dye, osmic acid or ruthenic acid to the cross section of the resin composition No. 1 dropwise with heating to about 80° C. to dye the domain particles therewith.

SYNTHESIS EXAMPLE 2

The procedure for preparation of the resin composition No. 1 in Synthesis Example 1 was repeated except that the mixture A-1 and the mixture B-1 used in Synthesis Example 1 were respectively replaced by a mixture A-2 and a mixture B-2 with the following formulations:

| | Weight |
|---|---|
| [Mixture A-2] | |
| Polyoxyethylene(2.2)-2,2-bis(4-hydroxyphenyl)propane | 370 g |
| Fumaric acid | 11 g |
| Isododecenylsuccinic anhydride | 54 g |
| Terephthalic acid | 112 g |
| Dibutyl tin oxide | 1.2 g |
| [Mixture B-2] | |
| Styrene | 800 g |
| 2-ethylhexyl acrylate | 200 g |
| 2,2'-azobis-4-methoxy-2,4-dimethylvaleronitrile | 50 g |

Thus, a resin composition No. 2 was obtained.

As a result of the differential thermal analysis of the resin composition No. 2, there was observed one peak of the glass transition temperature (Tg) at 62° C.

The acid value of the resin composition No. 2 was 5.3 KOH mg/g, and the insoluble content in chloroform was 16.4 wt. %.

When the condition of the resin composition No. 2 was observed by the SEM, it was confirmed that the domain particles with an average particle diameter of 1.3 μm were uniformly dispersed in the matrix.

SYNTHESIS EXAMPLE 3

The procedure for preparation of the resin composition No. 1 in Synthesis Example 1 was repeated except that the mixture A-1 and the mixture B-1 used in Synthesis Example 1 were respectively replaced by a mixture A-3 and a mixture B-3 with the following formulations:

| | Weight |
|---|---|
| [Mixture A-3] | |
| Polyoxyethylene(2.2)-2,2-bis(4-hydroxyphenyl)propane | 720 g |
| 6-aminocaproic acid | 13 g |
| n-octenylsuccinic acid | 180 g |
| [Mixture B-3] | |
| Styrene | 400 g |
| 2-ethylhexyl acrylate | 77 g |
| Divinylbenzene | 3 g |

Thus, a resin composition No. 3 was obtained.

As a result of the differential thermal analysis of the resin composition No. 3, there was observed one peak of the glass transition temperature (Tg) at 61.5° C.

The acid value of the resin composition No. 3 was 9.7 KOH mg/g, and the insoluble content in chloroform was 13.3 wt. %.

When the condition of the resin composition No. 3 was observed by the SEM, it was confirmed that the domain particles with an average particle diameter of 1.5 μm were uniformly dispersed in the matrix.

Comparative Synthesis Example 1

550 g of xylene were placed in a four-necked 2-l glass flask equipped with a thermometer, a stainless steel stirrer, a condenser, a nitrogen-introducing inlet and a dropping funnel. After the atmosphere was replaced by nitrogen, xylene was heated to 135° C.

A mixture of 700 g of styrene, 300 g of butyl methacrylate and 50 g of dicumyl peroxide was added dropwise to xylene through the dropping funnel over a period of 4 hours. The polymerization reaction was carried out at 135° C. for 5 hours. Thereafter, the reaction mixture was heated to 200° C. and the xylene component was distilled away from the mixture under reduced pressure. The thus obtained resin was moved to a vat to cool, and pulverized. The softening point of the thus obtained resin was 110° C. and the glass transition temperature thereof was 66° C. when measured in accordance with ASTM E-28-67.

A mixture of 1,000 g of the above prepared resin, 390 g of polyoxypropylene(2.2)-2,2-bis(4-hydroxyphenyl)propane, 120 g of isophthalic acid, 38 g of 1,2,5-benzenetricarboxylic acid, and 1 g of dibutyl tin oxide was placed in a four-necked 5-l glass flask equipped with a thermometer, a stainless steel stirrer, a condenser and a nitrogen-introducing inlet. The reaction mixture was heated at 220° C. in the mantle heater to cause the polymerization reaction.

The conversion of polymerization was followed by the measurement of the softening point of the mixture in accordance with the method described in ASTM E-28-67, and the polymerization reaction was terminated when the softening point of the mixture reached 120° C.

Thus, a resin composition No. 4 was obtained.

When the comparative resin composition No. 4, which was a pale yellow solid, was subjected to differential thermal analysis, there were observed two peaks characteristic of the glass transition temperature (Tg) at 61° C. and 65° C.

The acid value of the comparative resin composition No. 4 was 10 KOH mg/g, and the insoluble content in chloroform was 30 wt. %.

When the condition of the comparative resin composition No. 4 was observed by the SEM, it was confirmed that the domain particles and the matrix were not separated, but compatible in each other.

Comparative Synthesis Example 2

A mixture of 390 g of polyoxyethylene(2.2)-2,2-bis(4-hydroxyphenyl)propane, 12 g of fumaric acid, 55 g of isododecenylsuccinic anhydride, 110 g of terephthalic acid and 1 g of dibutyl tin oxide was subjected to polymerization. The conversion of polymerization was followed by the measurement of the softening point of the mixture in accordance with the method described in ASTM E-28-67, and the polymerization reaction was terminated when the softening point of the mixture reached 110° C. The glass transition temperature of the thus obtained resin was 65° C. according to the differential thermal analysis.

390 g of the above prepared resin and 550 g of xylene were placed in a four-necked 2-l glass flask equipped with a thermometer, a stainless steel stirrer, a condenser, a nitrogen-introducing inlet and a dropping funnel, and the resin was dissolved in xylene. After the atmosphere was replaced by nitrogen, the reaction mixture was heated to 135° C.

A mixture of 820 g of styrene, 180 g of 2-ethylhexyl acrylate and 40 g of azobisisobutyronitrile serving as a polymerization initiator was added dropwise to the above prepared resin solution through the dropping funnel over a period of 4 hours. The polymerization reaction was carried out at 135° C. for 5 hours. The conversion of polymerization was followed by the measurement of the softening point of the mixture in accordance with the method described in ASTM E-28-67. The polymerization reaction was terminated when the softening point of the mixture reached 120° C. Thereafter, the reaction mixture was heated to 200° C. and the xylene component was distilled away from the mixture under reduced pressure. The thus obtained resin was moved to a vat to cool, and pulverized.

Thus, a resin composition No. 5 was obtained.

When the comparative resin composition No. 5 was subjected to differential thermal, there were observed two peaks characteristic of the glass transition temperature (Tg) at 61° C. and 65° C.

The acid value of the comparative resin composition No. 5 was 18.0 KOH mg/g, and the insoluble content in chloroform was 23 wt. %.

When the condition of the comparative resin composition No. 5 was observed by the SEM, it was confirmed that the domain particles and the matrix were not separated, but compatible in each other.

Comparative Synthesis Example 3

The procedure for preparation of the resin composition No. 1 in Synthesis Example 1 was repeated except that the condensation polymerization of the mixture A-1 was carried out at a normal pressure of 760 Torr, so that a resin composition No. 6 was obtained.

As a result of the differential thermal analysis of the comparative resin composition No. 6, there was observed one peak characteristic of the glass transition temperature (Tg) at 61.5° C.

The acid value of the comparative resin composition No. 6 was 7.3 KOH mg/g, and the insoluble content in chloroform was 24.2 wt. %.

When the condition of the comparative resin composition No. 6 was observed by SEM, it was confirmed that the particle diameters of the domain particles were not even, ranging from 1 to 10 μm, and the domain particles with different sizes were dispersed in the matrix.

In the present invention, the toner may comprise a fluorine-containing quaternary ammonium salt, preferably a fluorine-containing quaternary ammonium salt compound of formula (I):

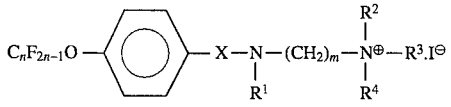

(I)

wherein X is —$SO_2$— or —CO—; $R^1$, $R^2$, $R^3$ and $R^4$ each is hydrogen, an alkyl group having 1 to 10 carbon atoms or an aryl group; and m and n are integers of 1 or more.

In this case, it is preferable that the amount of the fluorine-containing quaternary ammonium salt be in the range of 0.01 to 8 parts by weight, more preferably 0.1 to 2 parts by weight, to 100 parts by weight of the binder resin composition. When the amount of the fluorine-containing quaternary ammonium salt is within the above range, the change of the charge quantity of toner can efficiently be prevented even when the ambient conditions are changed, and at the same time, the fluorine-containing quaternary ammonium salt is sufficiently dispersed in the toner composition in the course of kneading.

Examples of the fluorine-containing quaternary ammonium salt for use in the present invention are as follows:

| Compound | |
|---|---|
| No. 1 | 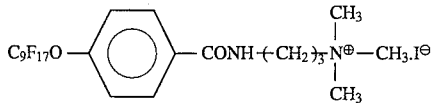 |
| No. 2 | 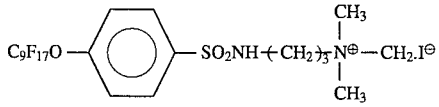 |
| No. 3 | 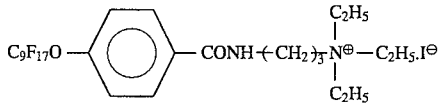 |
| No. 4 | 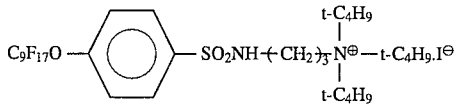 |
| No. 5 | 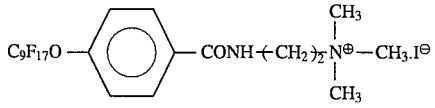 |
| No. 6 | 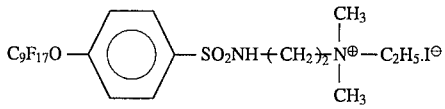 |
| No. 7 | 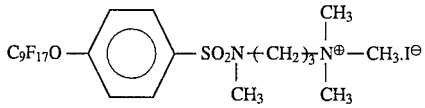 |
| No. 8 | 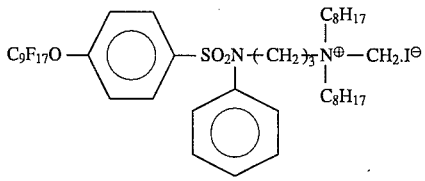 |
| No. 9 | 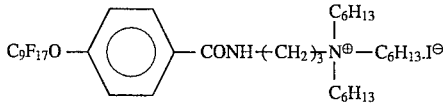 |
| No. 10 | 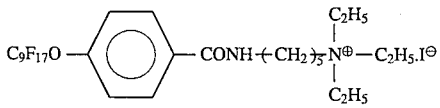 |

-continued

| Compound | |
|---|---|
| No. 11 | 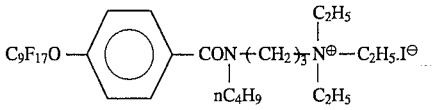 |
| No. 12 | 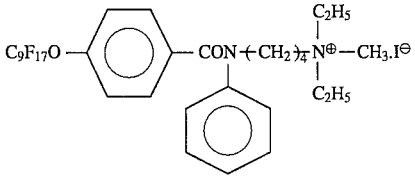 |
| No. 13 | 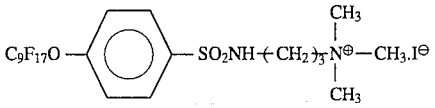 |
| No. 14 | 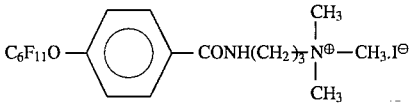 |
| No. 15 | 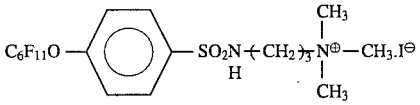 |
| No. 16 | 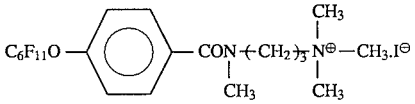 |
| No. 17 | 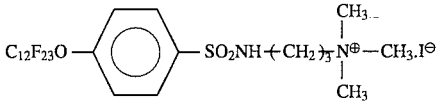 |

Moreover, the toner of the present invention may further comprise a releasing agent. Any conventional releasing agents can be employed, and in particular, it is preferable to use a carnauba wax free of a free aliphatic acid, a montan wax, and oxidized rice wax alone or in combination.

The carnauba wax which is obtained in the form of crystallites is suitable for the releasing agent for use in the toner of the present invention. It is preferable that the acid value of the carnauba wax be 5 or less, and the average particle diameter thereof be 1 μm or less when dispersed in the binder resin.

For the montan wax, a conventional montan ester wax obtained from a mineral by purification is preferably employed as the releasing agent in the toner of the present invention. It is preferable that the montan wax be in the form of crystallites, and that the acid value thereof be in the range of 5 to 14.

The previously mentioned oxidized rice wax can be obtained by oxidizing a rice bran wax in the air. It is preferable that the acid value of the oxidized rice wax be in the range of 10 to 30.

When the acid value of each wax is within the above range, the image-fixing at low temperature can be effectively achieved.

It is preferable that the total amount of the above-mentioned waxes serving as the releasing agents be in the range of 5 to 30 parts by weight, more preferably in the range of 7 to 20 parts by weight, to 100 parts by weight of the binder resin composition.

Examples of the coloring agent for use in the toner of the present invention are carbon black, lamp black, black iron, ultramarine blue, Aniline Blue, phthalocyanine blue, phthalocyanine green, Hansa Yellow G, Rhodamine 6G lake, Calconyl Blue, chrome yellow, quinacridone, Benzidine Yellow, Rose Bengale, triallymethane dyes, and disazo dyes and pigments. The above-mentioned conventional dyes and pigments can be employed alone or in combination.

The amount of the coloring agent is preferably in the range of 1 to 30 parts by weight, more preferably in the range of 3 to 20 parts by weight, to 100 parts by weight of the binder resin composition.

In addition, the toner according to the present invention can be used as a magnetic toner by adding a magnetic material thereto.

Examples of the magnetic material for preparation of the magnetic toner are iron oxides such as magnetite, hematite and ferrite; metals such as iron, cobalt and nickel; alloys of the above-mentioned magnetic metals and the following metals such as aluminum, cobalt, copper, lead, magnesium, tin, zinc, antimony, beryllium, bismuth, cadmium, calcium, manganese, selenium, titanium, tungsten and vanadium; and mixtures thereof.

It is preferable that the average particle diameter of the above-mentioned magnetic material be in the range of about 0.1 to 2 μm.

The amount of the magnetic material is preferably in the range of about 20 to 200 parts by weight, and more preferably in the range of 40 to 150 parts by weight, to 100 parts by weight of the binder resin composition.

In addition, the toner according to the present invention may further comprise other additives when necessary. Examples of the additives are lubricants such as Teflon and zinc stearate; abrasives such as cerium oxide and silicon carbide; fluidity-providing agents or caking inhibitors such as colloidal silica and aluminum oxide; electroconductivity-imparting agents such as carbon black and tin oxide; and a fixing-promoting agent such as a low-molecular weight polyolefin.

The toner according to the present invention can be used for a two-component developer in combination with a carrier. Any conventional carrier particles are available for the two-component developer. For example, finely-divided particles of the magnetic materials such as iron, ferrite and nickel, and glass beads may be employed. The carrier particles may be coated with a silicone resin, such as a commercially available silicone resin made by Shin-Etsu Chemical Co., Ltd., and a conventional carbon black may be contained in the resin layer of the carrier particles.

Other features of this invention will become apparent in the course of the following description of exemplary embodiments, which are given for illustration of the invention and are not intended to be limiting thereof.

Example 1

The following components were thoroughly mixed and stirred in a Henschel mixer, and kneaded in a two-roll mill at 130° to 140° C. for about 30 minutes. The thus obtained mixture was cooled to room temperature, and then pulverized and classified, whereby a toner No. 1 with a particle diameter of 5 to 20 μm according to the present invention was obtained:

| | Parts by Weight |
|---|---|
| Resin composition No. 1 (synthesized in Synthesis Example 1) | 100 |
| Carbon black "#C-44" (Trademark) made by Mitsubishi Chemical Industries, Ltd. | 10 |
| Chromium-containing azo dye "S-34" (trademark), made by Orient Chemical Industries, Ltd. | 2 |

When the rheological characteristics of the toner No. 1 were measured under a frequency of 100 Hz, the storage elastic modulus (G') at 90° C. was $5.5\times10^6$ dyne/cm$^2$, and the loss elastic modulus (G") at 210° C. was $5\times10^4$ dyne/cm$^2$.

The blocking resistance of the toner was evaluated in such a manner that about 30 g of the toner No. 1 were placed in a 200-ml plastic cup and allowed to stand in a thermostatic chamber of 50° C. for 24 hours. After 24 hours, the toner was visually inspected and evaluated in accordance with the following three ranks:

o(good): No agglomerate was observed.

Δ(slightly poor): Some agglomerates were recognized, but they easily went to pieces.

x (very poor): There were agglomerates, which did not easily go to pieces even by shaking the cup or holding the agglomerate in the hand.

The blocking resistance of the toner No. 1 according to the present invention was good.

Two parts by weight of the above prepared toner and 98 parts by weight of ferrite carrier particles were mixed in a ball mill for 15 minutes, whereby a two-component developer was fabricated.

The thus fabricated developer was subjected to an image formation test using a commercially available electrophotographic copying machine "FT-7570" (Trademark), made by Ricoh Company, Ltd., in which an image-fixing roller was coated by a silicone oil. As a result of the image formation test, the initial image was excellent. Even after 100,000 copies were made, the images were still excellent in quality.

Moreover, the lower limit temperature for image-fixing of the toner was as low as 135° C., and the hot off-set occurrence temperature was 240° C. or more.

The spent characteristics of the toner were evaluated by the following method: after the making of copies, 10 g of the developer were taken out of the copying machine. The toner component was removed from the developer by the blow-off method, and the carrier component was immersed in 1,000 g of toluene. Then, the turbidity of toluene was measured. The spent characteristics of the toner were regarded as inferior when the turbidity of toluene became 2 times or more the turbidity prior to the image formation test, and the toner deposition on the non-image area of the copy paper was observed.

The spent characteristics of the toner No. 1 were excellent after the making of 100,000 copies. High durability of the toner No. 1 was confirmed.

Example 2

The following components were thoroughly mixed and stirred in a Henschel mixer, and kneaded in a two-roll mill at 130° to 140° C. for about 30 minutes. The thus obtained mixture was cooled to room temperature, and then pulverized and classified, whereby a toner No. 2 with a particle diameter of 5 to 20 μm according to the present invention was obtained:

| | Parts by Weight |
|---|---|
| Resin composition No. 2 (synthesized in Synthesis Example 2) | 100 |
| Carbon black "#C-44" (Trademark) made by Mitsubishi Chemical Industries, Ltd. | 9 |
| Iron-containing monoazo dye "T-77" (Trademark),made by Hodogaya Chemical Co., Ltd. | 2 |
| Carnauba wax "NX-A-03" (Trademark) made by Noda Wax Co., Ltd. | 4 |

When the rheological characteristics of the toner No. 2 were measured under a frequency of 100 Hz, the storage elastic modulus (G') at 90° C. was $8.5\times10^6$ dyne/cm$^2$, and the loss elastic modulus (G") at 210° C. was $6.5\times10^4$ dyne/cm$^2$.

When the blocking resistance of the toner was evaluated in the same manner as in Example 1, good results were obtained.

Three parts by weight of carbon black "Ketjen black" (Trademark), made by Lion Akzo Co., Ltd. were added to 100 parts by weight of a silicone resin "SR-2400" (Trademark), made by Dow Corning Torey Silicone Co., Ltd. The above obtained carbon-black-containing silicone resin was coated on ferrite particles, so that carrier particles were prepared. Two parts by weight of the above prepared toner No. 2 and 98 parts by weight of the above prepared ferrite carrier particles were mixed and stirred in a ball mill for 15 minutes, whereby a two-component developer was fabricated.

Using the thus fabricated developer, the image formation test was carried out in the same manner as in Example 1 except that the image-fixing roller in the electrophotographic copying machine was not coated by the silicone oil. As a result of the image formation test, the initial image was excellent. Even after 100,000 copies were made, the images were still excellent in quality.

Moreover, the lower limit temperature for image-fixing of the toner was as low as 130° C., and the hot off-set occurrence temperature was 240° C. or more.

The spent characteristics of the toner were evaluated by the same method as in Example 1. The spent characteristics of the toner No. 2 were excellent after the making of 100,000 copies. High durability of the toner No. 2 was confirmed.

Example 3

The procedure for preparation of the toner No. 1 according to the present invention in Example 1 was repeated except that the formulation for the toner No. 1 in Example 1 was changed to the following formulation for a toner No. 3:

[Formulation for toner No. 3]

| | Parts by Weight |
|---|---|
| Resin composition No. 3 (synthesized in Synthesis Example 3) | 100 |
| Carbon black "#C-44" (Trademark) made by Mitsubishi Chemical Industries, Ltd. | 9 |

-continued

| [Formulation for toner No. 3] | Parts by Weight |
|---|---|
| Chromium-containing azo dye "S-34" (Trademark), made by Orient Chemical Industries, Ltd. | 3 |
| Montan wax made by Hoechst Japan Limited. | 4 |

Thus, a toner No. 3 according to the present invention was obtained. When the rheological characteristics of the toner No. 3 were measured under a frequency of 100 Hz, the storage elastic modulus (G') at 90° C. was $1\times10^7$ dyne/cm$^2$, and the loss elastic modulus (G") at 210° C. was $9\times10^4$ dyne/cm$^2$.

When the blocking resistance of the toner was evaluated in the same manner as in Example 1, good results were obtained.

Two parts by weight of the above prepared toner No. 3 and 98 parts by weight of ferrite carrier particles were mixed in a ball mill for 15 minutes, whereby a two-component developer was fabricated.

Using the thus fabricated developer, the image formation test was carried out in the same manner as in Example 1. As a result of the image formation test, the initial image was excellent. Even after 100,000 copies were made, the images were still excellent in quality.

Moreover, the lower limit temperature for image-fixing of the toner was as low as 125° C., and the hot off-set occurrence temperature was 240° C.

The spent characteristics of the toner were evaluated by the same method as in Example 1. The spent characteristics of the toner No. 3 were excellent after the making of 100,000 copies. High durability of the toner No. 3 was confirmed.

Comparative Example 1

[Synthesis of Resin (I) for Domain Particles]

A mixture of the following components was subjected to polymerization reaction at 85° C. for 24 hours:

| | Weight |
|---|---|
| Styrene | 102 g |
| n-butyl acrylate | 68 g |
| Benzoyl peroxide | 15 g |
| Toluene | 500 g |

Thus, a resin (I) with a glass transition temperature of 38.3° C. was obtained.

[Synthesis of Resin (II) for Matrix]

A mixture of the following components was subjected to polymerization reaction at 85° C. for 24 hours:

| | Weight |
|---|---|
| Styrene | 252 g |
| n-butyl acrylate | 39 g |
| Monobutyl maleate (half ester) | 9 g |
| Benzoyl peroxide | 22.5 g |
| Toluene | 750 g |

Thus, a resin (II) with a glass transition temperature of 61.5° C. and an acid value of 51.2 was obtained.

Three parts by weight of the resin (I) and 7 parts by weight of the resin (II) were mixed after both resins were dried. The mixture thus obtained was vigorously stirred at 150° C., and rapidly cooled, whereby a comparative resin composition No. 7 was obtained. In the resin composition No. 7 the resin particles (I) with an average particle diameter of 1.9 μm were dispersed in the resin (II). However, the particle diameters of the resin particles (I) were ranging from 0.1 to 8 μm, so that the domain particles were uneven.

[Preparation of Toner]

The procedure for preparation of the toner No. 1 according to the present invention in Example 1 was repeated except that the resin composition No. 1 used in the formulation for the toner No. 1 in Example 1 was replaced by the above prepared resin composition No. 7.

Thus, a comparative toner No. 1 was obtained.

When the rheological characteristics of the comparative toner No. 1 were measured under a frequency of 100 Hz, the storage elastic modulus (G') at 90° C. was $5\times10^8$ dyne/cm$^2$, and the loss elastic modulus (G") at 210° C. was $1\times10^2$ dyne/cm$^2$.

When the blocking resistance of the comparative toner No. 1 was evaluated in the same manner as in Example 1, good results were obtained.

Two parts by weight of the above prepared comparative toner No. 1 and 98 parts by weight of ferrite carrier particles were mixed in a ball mill for 15 minutes, whereby a two-component developer was fabricated.

Using the thus fabricated developer, the image formation test was carried out in the same manner as in Example 1. The lower limit temperature for image-fixing of the comparative toner No. 1 was 155° C., and the hot off-set occurrence temperature was 230° C.

The spent characteristics of the toner were evaluated by the same method as in Example 1. The spent characteristics of the comparative toner No. 1 were regarded as inferior because it was confirmed that a large quantity of spent toner precipitated in toluene when the developer was put in toluene after the making of 1,000 copies. In addition, the toner deposition on the non-image areas was observed because the amount of the spent toner was increased, thereby decreasing the charge quantity of the toner.

Comparative Example 2

The procedure for preparation of the toner No. 1 according to the present invention in Example 1 was repeated except that the resin composition No. 1 used in the formulation for the toner No. 1 in Example 1 was replaced by the comparative resin composition No. 4 synthesized in Comparative Synthesis Example 1.

Thus, a comparative toner No. 2 was obtained.

When the rheological characteristics of the comparative toner No. 2 were measured under a frequency of 100 Hz, the storage elastic modulus (G') at 90° C. was $2\times10^9$ dyne/cm$^2$, and the loss elastic modulus (G") at 210° C. was $5\times10^2$ dyne/cm$^2$.

When the blocking resistance of the comparative toner No. 2 was evaluated in the same manner as in Example 1, the results were slightly poor.

Two parts by weight of the above prepared comparative toner No. 2 and 98 parts by weight of ferrite carrier particles were mixed in a ball mill for 15 minutes, whereby a two-component developer was fabricated.

Using the thus fabricated developer, the image formation test was carried out in the same manner as in Example 1. The lower limit temperature for image-fixing of the comparative toner No. 2 was 160° C., and the hot off-set occurrence temperature was 200° C. These temperatures proved that the comparative toner No. 2 was not suitable for the practical use.

The spent characteristics of the toner were evaluated by the same method as in Example 1. The spent characteristics of the comparative toner No. 2 were regarded as inferior because it was confirmed that a large quantity of spent toner precipitated in toluene when the developer was put in toluene after the making of 1,000 copies. In addition, the toner deposition on the non-image areas was observed because the amount of the spent toner was increased, thereby decreasing the charge quantity of the toner.

Comparative Example 3

The procedure for preparation of the toner No. 2 according to the present invention in Example 2 was repeated except that the resin composition No. 2 used in the formulation for the toner No. 2 in Example 2 was replaced by the comparative resin composition No. 5 synthesized in Comparative Synthesis Example 2.

Thus, a comparative toner No. 3 was obtained.

When the rheological characteristics of the comparative toner No. 3 were measured under a frequency of 100 Hz, the storage elastic modulus (G') at 90° C. was $1.5\times10^8$ dyne/cm$^2$, and the loss elastic modulus (G") at 210° C. was $8.5\times10^2$ dyne/cm$^2$.

When the blocking resistance of the comparative toner No. 3 was evaluated in the same manner as in Example 1, the results were very poor.

The procedure for preparation of the developer in Example 2 was repeated except that the toner No. 2 according to the present invention in Example 2 was replaced by the comparative toner No. 3. Thus, a two-component developer was fabricated.

Using the thus fabricated developer, the image formation test was carried out in the same manner as in Example 2. The lower limit temperature for image-fixing of the comparative toner No. 3 was 155° C., and the hot off-set occurrence temperature was 210° C.

The spent characteristics of the toner were evaluated by the same method as in Example 1. The spent characteristics of the comparative toner No. 3 were regarded as inferior because it was confirmed that a large quantity of spent toner precipitated in toluene when the developer was put in toluene after the making of 1,000 copies. In addition, the toner deposition on the non-image areas was observed because the amount of the spent toner was increased, thereby decreasing the charge quantity of the toner.

Comparative Example 4

The procedure for preparation of the toner No. 1 according to the present invention in Example 1 was repeated except that the resin composition No. 1 used in the formulation for the toner No. 1 in Example 1 was replaced by the comparative resin composition No. 6 synthesized in Comparative Synthesis Example 3.

Thus, a comparative toner No. 4 was obtained.

When the rheological characteristics of the comparative toner No. 4 were measured under a frequency of 100 Hz, the storage elastic modulus (G') at 90° C. was $9\times10^7$ dyne/cm$^2$, and the loss elastic modulus (G") at 210° C. was $9\times10^4$ dyne/cm$^2$.

When the blocking resistance of the comparative toner No. 4 was evaluated in the same manner as in Example 1, the results were very poor.

Two parts by weight of the above prepared comparative toner No. 4 and 98 parts by weight of ferrite carrier particles were mixed in a ball mill for 15 minutes, whereby a two-component developer was fabricated.

Using the thus fabricated developer, the image formation test was carried out in the same manner as in Example 1. The lower limit temperature for image-fixing of the comparative toner No. 4 was 135° C., and the hot off-set occurrence temperature was 240° C. or more.

The spent characteristics of the toner were evaluated by the same method as in Example 1. The spent characteristics of the comparative toner No. 4 were regarded as inferior because it was confirmed that a large quantity of spent toner precipitated in toluene when the developer was put in toluene after the making of 10,000 copies. In addition, the toner deposition on the non-image areas was observed because the amount of the spent toner was increased, thereby decreasing the charge quantity of the toner.

The rheological characteristics of the toners prepared in Examples 1 to 3 and Comparative Examples 1 to 4, and the evaluation results are shown in Table 1.

TABLE 1

| | Resin Composition | Lower Limit Temperature for Image-Fixing (°C.) | Hot Off-set Occurrence Temperature (°C.) | G' (*) (dyne/cm$^2$) | G" (**) (dyne/cm$^2$) | Spent Characteristics of Toner (***) | Blocking Resistance of Toner |
|---|---|---|---|---|---|---|---|
| Ex. 1 | No. 1 | 135 | 240 or more | $5.5\times10^6$ | $5\times10^4$ | excellent after making of 100,000 copies | ○ |
| Ex. 2 | No. 2 | 130 | 240 or more | $8.5\times10^6$ | $6.5\times10^4$ | excellent after making of 100,000 copies | ○ |
| Ex. 3 | No. 3 | 125 | 240 | $1\times10^7$ | $9\times10^4$ | excellent after making of 100,000 copies | ○ |
| Comp. Ex. 1 | No. 7 | 155 | 230 | $5\times10^8$ | $1\times10^2$ | inferior after making of 1,000 copies | ○ |
| Comp. Ex. 2 | No. 4 | 160 | 200 | $2\times10^9$ | $5\times10^2$ | inferior after making of 1,000 copies | Δ |
| Comp. Ex. 3 | No. 5 | 155 | 210 | $1.5\times10^8$ | $8.5\times10^2$ | inferior after making of 1,000 copies | X |
| Comp. Ex. 4 | No. 6 | 135 | 240 or more | $9\times10^7$ | $9\times10^4$ | inferior after making of 10,000 copies | X |

TABLE 1-continued

| Resin Composition | Lower Limit Temperature for Image-Fixing (°C.) | Hot Off-set Occurrence Temperature (°C.) | G' (*) (dyne/cm$^2$) | G" (**) (dyne/cm$^2$) | Spent Characteristics of Toner (***) | Blocking Resistance of Toner |
|---|---|---|---|---|---|---|

(*) G': storage elastic modulus at 90° C. under a frequency of 100 Hz.
(**) G": loss elastic modulus at 210° C. under a frequency of 100 Hz.
(***) The spent characteristics of the toner were evaluated by causing the spent toner attached to the carrier particles to precipitate in toluene.

Example 4

The procedure for preparation of the toner No. 1 according to the present invention in Example 1 was repeated except that the formulation for the toner No. 1 in Example 1 was changed to the following formulation for a toner No. 4:

[Formulation for toner No. 4]

| | Parts by Weight |
|---|---|
| Resin composition No. 1 (synthesized in Synthesis Example 1) | 100 |
| Carbon black "#C-44" (Trademark) made by Mitsubishi Chemical Industries, Ltd. | 10 |
| Fluorine-containing quaternary ammonium salt compound no. 2 | 1 |

Thus, a toner No. 4 according to the present invention was obtained. Using the toner No. 4 of the present invention, a developer was prepared in the same manner as in Example 1.

The charge quantity of the toner No. 4 was −21.3 μC/g under the circumstances of 10° C. and 15% RH, and the charge quantity thereof was −20.1 μC/g under the circumstances of 30° C. and 90% RH. It was confirmed that the change in charge quantity of the toner was very small even though the ambient conditions were changed.

The lower limit temperature for image-fixing and the hot off-set occurrence temperature of the toner No. 4 according to the present invention were similar to those of the toner No. 1 according to the present invention.

The spent characteristics of the toner No. 4 according to the present invention were excellent.

Example 5

The procedure for preparation of the toner No. 1 according to the present invention in Example 1 was repeated except that the formulation for the toner No. 1 in Example 1 was changed to the following formulation for a toner No. 5:

[Formulation for toner no. 5]

| | Parts by Weight |
|---|---|
| Resin composition No. 2 (synthesized in Synthesis Example 2) | 100 |
| Carbon black "#C-44" (Trademark) made by Mitsubishi Chemical Industries, Ltd. | 9 |
| Iron-containing monoazo dye "T-77" (Trademark), made by Hodogaya Chemical Co., Ltd. | 2 |
| Carnauba wax "NX-A-03" (Trademark) made by Noda Wax Co., Ltd. | 4 |
| Fluorine-containing quaternary ammonium salt compound No. 7 | 1.2 |

Thus, a toner No. 5 according to the present invention was obtained. Using the toner No. 5 of the present invention, a developer was prepared in the same manner as in Example 1.

The charge quantity of the toner was −23.4 μC/g under the circumstances of 10° C. and 15% RH, and the charge quantity was −21.9 μC/g under the circumstances of 30° C. and 90% RH. It was confirmed that the change in charge quantity of the toner was very small even though the ambient conditions were changed.

The lower limit temperature for image-fixing and the hot off-set occurrence temperature of the toner No. 5 according to the present invention were similar to those of the toner No. 2 according to the present invention.

The spent characteristics of the toner No. 5 according to the present invention were excellent.

The charge quantities of the toners obtained in Examples 1 to 5 and Comparative Examples 1 to 4 at 10° C. and 15% RH, and at 30° C. and 90% RH are shown in Table 2.

TABLE 2

| | Charge Quantity of Toner (10° C., 15% RH) [μC/g] | Charge Quantity of Toner (30° C., 90% RH) [μC/g] |
|---|---|---|
| Ex. 1 | −25.6 | −19.8 |
| Ex. 2 | −22.5 | −17.8 |
| Ex. 3 | −24.1 | −20.6 |
| Ex. 4 | −21.3 | −20.1 |
| Ex. 5 | −23.4 | −21.9 |
| Comp. Ex. 1 | −19.2 | −10.4 |
| Comp. Ex. 2 | −24.7 | −18.7 |
| Comp. Ex. 3 | −28.2 | −15.1 |
| Comp. Ex. 4 | −24.9 | −19.0 |

As previously explained, the off-set phenomenon can be efficiently prevented at the image-fixing process and the image-fixing at a low temperature can be achieved when the toner of the present invention is used. In addition, the desired charge quantity of the toner can be obtained, and the change in charge quantity of the toner can be minimized even when the environmental conditions are changed. Thus, toner images with high fidelity can constantly be obtained in the repeated copying operation, and the winding of the toner-image-bearing copy paper around the image-fixing heated roller can be prevented because of excellent releasability of the toner. Therefore, the toner of the present invention is suitable for high-speed copying operation.

Japanese Patent Application No. 5-172999 filed in Jul. 13, 1993 and Japanese Patent Application No. 6-153593 filed in Jul. 5, 1994 are hereby incorporated by reference.

What is claimed is:

1. A toner for developing latent electrostatic images comprising:

a coloring agent, and a binder resin composition comprising resin particles, each resin particle comprising a matrix and domain particles with an average particle diameter of 0.5 to 2.0 μm dispersed in said matrix;

said toner having such rheological characteristics that the storage elastic modulus (G') thereof at 80° to 100° C. under a frequency of 100 Hz is in the range of $5\times10^6$ to $5\times10^7$ dyne/cm$^2$, and the loss elastic modulus (G") thereof at 200° to 220° C. under a frequency of 100 Hz is in the range of $1\times10^3$ to $1\times10^5$ dyne/cm$^2$.

2. The toner as claimed in claim 1, wherein said domain particles for use in said binder resin composition comprise a vinyl resin, and said matrix comprises at least one resin selected from the group consisting of polyester, polyester amide, and polyamide.

3. The toner as claimed in claim 1, wherein said binder resin composition has an acid value of 15 KOH mg/g or less, and comprises components which are insoluble in chloroform in an amount of 30 wt. % or less.

4. The toner as claimed in claim 1, further comprising a fluorine-containing quaternary ammonium salt compound of formula (I):

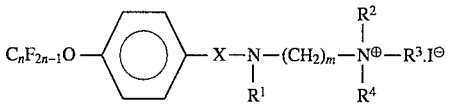

(I)

wherein X is —$SO_2$— or —CO—; $R^1$, $R^2$, $R^3$ and $R^4$ each is hydrogen, an alkyl group having 1 to 10 carbon atoms or an aryl group; and m and n are integers of 1 or more.

* * * * *